US007357525B2

(12) United States Patent
Doyle

(10) Patent No.: US 7,357,525 B2
(45) Date of Patent: Apr. 15, 2008

(54) LED POOL OR SPA LIGHT HAVING UNITARY LENS BODY

(76) Inventor: Kevin Doyle, 15767 Menton Bay Ct., Delray Beach, FL (US) 33446

( * ) Notice: Subject to any disclaimer, the term of this patent is extended or adjusted under 35 U.S.C. 154(b) by 0 days.

(21) Appl. No.: 11/357,959

(22) Filed: Feb. 22, 2006

(65) Prior Publication Data

US 2006/0187652 A1 Aug. 24, 2006

Related U.S. Application Data

(60) Provisional application No. 60/654,463, filed on Feb. 22, 2005.

(51) Int. Cl.
*F21V 33/00* (2006.01)

(52) U.S. Cl. ..... 362/101; 362/96; 362/158; 362/800

(58) Field of Classification Search ..... 362/96, 362/101, 231, 240, 158, 267, 800, 257; 315/185, 315/193

See application file for complete search history.

(56) References Cited

U.S. PATENT DOCUMENTS

| | | | | |
|---|---|---|---|---|
| 3,814,051 | A * | 6/1974 | Lewison | 118/728 |
| 6,184,628 | B1 * | 2/2001 | Ruthenberg | 315/185 R |
| 6,616,291 | B1 * | 9/2003 | Love | 362/101 |
| 6,739,733 | B1 * | 5/2004 | Lamke et al. | 362/646 |
| 6,971,760 | B2 * | 12/2005 | Archer et al. | 362/101 |
| 7,040,779 | B2 * | 5/2006 | Lamke et al. | 362/231 |
| 7,125,146 | B2 * | 10/2006 | Willis et al. | 362/267 |

* cited by examiner

*Primary Examiner*—John Anthony Ward
(74) *Attorney, Agent, or Firm*—Tangent Law Group; Eric J. Weierstall, Esq.

(57) ABSTRACT

The instant invention is directed to a light emitting diode pool or spa lamp bulb having at least one light emitting diode with at least one lens body that is optically clear. The at least one light emitting diode being embedded in the lens body, the lens body being in direct contact with the pool or spa.

51 Claims, 7 Drawing Sheets

LED POOL OR SPA LIGHT HAVING UNITARY LENS BODY

CROSS REFERENCE TO RELATED APPLICATIONS

This application claims benefit of the earlier filed U.S. Provisional Application Ser. No. 60/654,463 filed Feb. 22, 2005, which is incorporated herein by reference.

FIELD OF THE INVENTION

The invention relates to an apparatus and method for lighting water in a water feature, particularly for lighting water with Light Emitting Diodes (LEDs) in a pool or spa light, and even more particularly to an improved, unitary lens body pool or spa light having LEDs.

BACKGROUND OF THE INVENTION

Increasingly, the popularity of using water as an integral part of domestic landscaping has moved landscapers to push further and further into decorative aspects for these water features. These features are incorporated through swimming pools, spas, ponds, lakes and other water features and sources in the typical yard. In addition to the natural beauty associated with these features by applying the proper lighting the beauty of these water features can be extended to include evening viewing and operation.

Typically, underwater lighting systems for such applications as spas, pools, and hot tubs use a 12-volt incandescent light bulb that screws into a molded plastic water-sealed housing. An example of the conventional, high intensity incandescent pool lighting system that uses a watertight compartment to contain a high intensity bulb or filament and passes the light through a lens to the pool can be seen in U.S. Pat. No. 6,203,173 to Duff et al. The housings are typically mounted below the spa or pool water level. This provides an attractive colored glow to the water in pools, tubs, and spas when in operation. It also provides an added safety measure on entry and exit. Variations in color are typically provided for through snap-on lenses, usually in red and blue tints, to alter the appearance and effect of the spa lighting.

However, these incandescent bulb systems have a number of disadvantages. Two of the principal disadvantages are a lack of reliability and durability. An incandescent bulb system frequently fails during its initial warranty period. The bulbs of these systems are typically only rated for about one thousand hours of operational life. With two to three hours of use per day, the bulb will typically require replacement yearly. The bulb filament is also very fragile, making transport and installation problematic. This is true even after installation as the high temperatures needed during operation continue to make the filament susceptible to damage from swimmers impacts with the device. This means that the system is difficult to maintain and even when properly maintained it can be easily damaged during normal operation.

These disadvantages are coupled with the fact that incandescent bulbs are inefficient and convert most of their energy to heat with as little as 10% of their energy producing light. This inefficiency is further compounded by the fact that in heretofore known designs the light must be transmitted across a gap in the bulb and/or housing and then through a lens prior to reaching the transmission horizon with the water of the spa or pool resulting in further losses. Thus, the typical incandescent system is unreliable, fragile, and inefficient at transmitting luminosity into the spa or pool.

Light Emitting Diode (LED) technology is generally more durable and longer lasting. Because of these qualities, LED systems have been applied in numerous lighting appliances, from handheld lamps to traffic lights. These LED systems have significant advantages in longevity and cost in comparison to incandescent lighting systems and can successfully replace incandescent systems. For example, U.S. Pat. Nos. 5,165,778 and 5,211,469 to Matthias et al. depict the use of a single LED located at the end of a wire and placed within an aquarium at a desired location within or near an ornamental object placed inside the aquarium to replace an incandescent bulb lighting system. Though these systems provide for waterproof LEDs, the lighting board and controllers are not encased in a singular housing encasing all the components necessary for pool or spa lights. Moreover, there is no lens housing with a diffuser or similar structure that is necessary for illuminating a pool or larger body of water.

Similarly, U.S. Pat. No. 5,561,346 to Byrne depicts an LED lamp construction for a traffic light for providing a low voltage light means for traffic signals. The colors are provided by the colored lenses generally attached to traffic signal lamps are known in the art. U.S. Pat. No. 5,890,794 to Abtahi, et al shows a further utilization of LED technology in an oil filled lighting unit. The lighting unit is comprised of LEDs that are in direct contact with the oil. The oil is chosen for its specific refractory properties and provides improved cooling and brightness. However, this system is ill suited for use in pools. Though the LEDs are waterproofed by an encapsulation layer, the transmission through the oil to the lens provides only a limited increase in the transmission of luminosity of the LEDs. The system fails to show an LED pool or spa lamp with a lens body with the LEDs encapsulated within the lens body.

U.S. Pat. No. 5,927,845 to Gustafson et al. shows a light strip with an n integral LED. The LED strip contains led within a thermoplastic housing to waterproof the LEDs. This is accomplished, as shown, by sandwiching the LEDs in two layers of the encapsulating material. This process does not provide for the type of housing utilized in the creation of a spa or pool light, as the shape and diffuser elements cannot be attained.

However, use of LED technology is also known in the art of pool and spa lighting. U.S. Pat. No. 6,616,291 to Love discloses an LED pool light with a plurality of multi-color LEDs that are held in a watertight compartment within a housing. The watertight compartment is used to protect the LED and its printed circuit board from the pool water. However, the air space diminishes the full transmission of the luminosity of the LED board and does not provide for additional cooling. It also increases the production costs of the LED pool light disclosed, requiring additional manufacturing to provide the compartment.

Similarly, in U.S. Pat. No. 6,528,954 to Lys et al., a "smart" spa bulb is provided, having an LED array and a controller in a replacement bulb configuration. The bulb retains the shape and configuration of an incandescent system and acts as a direct replacement. However, the system still maintains a watertight air gap that decreases the transmission of light into the pool or spa and does not provide for sufficient heating of the LED elements. This is further compounded by the watertight space between the lens of the "bulb" and the lens that interfaces with the pool or spa.

Likewise, in U.S. Pat. No. 6,184,628 to Ruthenberg and U.S. Pat. No. 6,435,691 to Macey, et al. an LED lighting board is provided in a fixture with a lens and a watertight compartment separating the LEDs from the lens as disclosed. Again, a gap or watertight air space is provided between the lens and the LED lighting board. This reduces the efficiency of the transmission of light from the LEDs to the pool or spa. It does not allow for the more efficient cooling that is achieved by omitting the watertight compartment nor does it provide the improved cooling and reduced cost associated with omitting these gaps.

None of the aforementioned devices provides the ability to maximize the intensity and transmission of the light from the LED into the spa or pool and provide cooling of the LEDs, allowing them to be run at a higher intensity, through direct contact of the LEDs with a lens body within the fixture to the water. Additionally, no feature has been able to achieve the desired superior luminescence, efficiency, and coloring while maintaining durability, increasing dependability, increasing ease of maintenance, and decreasing manufacturing costs. There exists a need to safely and costs effectively provide a greater luminescence and durability within the spa or pool light. There should also be a greater ability to control and color the pool or spa, including the ability to color wash and transition between colors within a pool or spa.

SUMMARY OF THE INVENTION

An object of the invention is to provide a higher luminosity light in pools or spas through the use of LED lighting fixtures contained in a single fixture.

A further object of the invention is to provide a light fixture with the ability to maximize the intensity and transmission of the light from an LED into a spa or pool and provide cooling of the LEDs, allowing them to be run at a higher intensity, through direct contact of the LEDs lens within the fixture to the water.

Yet another object of the invention is to provide an LED bulb with superior luminescence and coloring while maintaining durability, increasing dependability, increasing ease of maintenance, and decreasing manufacturing costs.

An object of the invention is to provide higher intensity LEDs without diminishing their operational life through the additional cooling provided by direct contact of the LEDs with the lens body that is in direct contact with the water in the pool or spa.

An object of the instant invention is to provide illumination of spa or pool by using light emitting diodes which are encapsulated or embedded inside a lens body with the LEDs exposed directly to the water or indirectly to the water through the enveloping of the LEDs in the lens body and the lens body directly contacting the water, using the water as a means of cooling the LEDs and preventing them from overheating and shortening the life of the LEDs.

A still further object of the instant invention is to provide a system for exposing LEDs without any gap of air or similar water tight space directly to the water in a pool or spa to provide better light transfer into the water, which yields better illumination of the pool or spa and the ability to wash several colors through the pool or spa.

The invention includes an apparatus, an article of manufacture, and a method for making the article.

The apparatus of the invention includes a light emitting diode pool or spa lamp bulb having an at least one light emitting diode and an at least one lens body. The lens body can be optically clear and heat transmissive with the at least one light emitting diode embedded in the lens body, the lens being in direct contact with the pool or spa and an at least one controller that is coupled to a printed circuit board, the printed circuit board being coupled to and mounting the at least one light emitting diode.

The printed circuit board can mount the at least one controller. The printed circuit board and the controller can also be embedded in the lens body. The controller can be located outside the bulb. The controller can be a wireless controller system having a wireless controller coupled wirelessly to a user input.

A power source can be coupled to the printed circuit board through a coupling. The coupling can be a screw in coupling. The coupling can also be a pin and plug coupling. A transformer coupling the power source and the printed circuit board can also be provided.

A rectifier circuit coupling the power source to the printed circuit board can additionally be provided.

The at least one light emitting diode can be a plurality of light emitting diodes. The plurality of light emitting diode can be a plurality of multi colored light emitting diodes.

In addition, a receiving cavity and a bezel can be provided, the bezel fitting around the light emitting diode bulb and retaining the bulb in the receiving cavity.

The lens body can further include a diffusing pattern on a surface of the lens body in contact with the pool or spa. The diffusing pattern can be comprised of a plurality of indents or projections in at least one of a series of concentric rings, a grid of squares, a grid of rectangles, a grid of small circles, and a grid of diamonds.

The controller can include a rectifier circuit for converting a 12 volt-ac source applied to the light emitting diode lamp bulb through electrical connections in a screw-type base to a 12 volt-dc circuit for supplying electrical power to an arrays comprised of the plurality of different colored light emitting diode bulbs. A hardened layer may also be included, the layer being applied over the lens body. The hardened layer can be, for instance, a layer of quartz applied over the lens body.

The invention also includes a pool or spa light, the light being recessed in an alcove in the wall or floor of the pool or spa, the light having a plurality of light emitting diodes, a printed circuit board having the plurality of light emitting diodes planted thereon, an at least one unitary lens body, the lens body being comprised of an optically transmissive material that encapsulates the plurality of light emitting diodes and the printed circuit board and an electrical coupling that couples the multiple light emitting diodes to a power source. The printed circuit board and plurality of light emitting diodes are encapsulated in the lens body and oriented to face into the pool or spa such that no gap or air space is provided and when the lens body is submerged in the pool or spa the multiple light emitting diodes are in direct contact with the lens body which is directly cooled by the pool or spa.

An at least one controller controlling the plurality of light emitting diodes can also be provided. The printed circuit board can mount the at least one controller thereon. The controller can be also embedded in the lens body. The controller can also be located outside the bulb. The controller can be a wireless controller system having a wireless controller coupled wirelessly to a user input.

The electrical coupling can be a screw in coupling or the coupling can be a pin and plug coupling. A transformer coupling the power source and the light emitting diodes can also be provided. A rectifier circuit coupling the power source to the printed circuit board can also be provided.

The plurality of light emitting diode can be a plurality of multi colored light emitting diodes. A bezel can be provided, the bezel fitting around the light emitting diode bulb and retaining the bulb in the receiving alcove. The lens body can also include a diffusing pattern on a surface in contact with the pool or spa. The diffusing pattern can be comprised of a plurality of indents or projections in at least one of a series of concentric rings, a grid of squares, a grid of rectangles, a grid of small circles, and a grid of diamonds.

A controller that includes a rectifier circuit for converting a 12-volt-ac source applied to the plurality of light emitting diodes through electrical connections in a screw-type base to a 12 volt-dc circuit for supplying electrical power to the plurality of multi-colored light emitting diodes can also be provided. A hardened layer may also be included, the layer being applied over the lens body. The hardened layer can be, for instance, a layer of quartz applied over the lens body.

The method of the invention includes a method of manufacturing an light emitting diode spa or pool bulb, the method includes the steps of setting a plurality of light emitting diodes on a printed circuit board in a in a lens body mold, adding water clear encapsulating material to the lens body mold to encapsulate all electrical components with an electrical coupling at the back of the mold, and ejecting the completed light emitting diode bulb.

The method can further include the method step of applying a diffuser pattern in the bulb. The method step of setting can further include setting a printed circuit board with a controller and a transformer, the transformer being coupled to the printed circuit board and having an electrical coupling, wherein in the encapsulating step the electrical coupling from the transformer extends out from the encapsulation. The method can further include the method step of applying a hardened surface coating to the light emitting diode bulb. The method of applying a hardened surface coating can further include applying a coating of quartz to the light emitting diode bulb.

The invention also includes a pool or spa light mounted within a pool or spa comprising an at least one lens body with at least one light emitting diode embedded and extending at least partially from the at least one lens body, a mounting cavity within the pool or spa having the lens body mounted therein and an at least one covering lens mounted in front of the lens body to form a water filled cavity, the at least one covering lens having an at least one water inlet and an at least one water outlet, wherein water is induced into and out of the cavity by a convective current generated from the cooling of the heat generated by the at least one light emitting diode.

The at least one light emitting diode can be a plurality of light emitting diodes. The plurality of light emitting diodes can be of multiple colors. The pool or spa light of can also include a controller, which can be provided to control the color of the plurality of light emitting diodes. The pool or spa light can also include at least one of a transformer, a power source cord, an electrical coupling, an at least one printed circuit board, and a bezel. The controller, the transformer, and the at least one printed circuit board can be embedded in the at least one lens body. The pool or spa light of wherein the at least one lens body is a single lens body. The single lens body can be composed of a thermally conductive, optically clear material. The pool or spa light can further comprise a protective coating covering the at least one lens body and the at least one light emitting diode. The at least one covering lens can be formed as a part of the at least one lens body. The at least one covering lens can also be separate from the at least one lens body.

Moreover, the above objects and advantages of the invention are illustrative, and not exhaustive of those that can be achieved by the invention. Thus, these and other objects and advantages of the invention will be apparent from the description herein, both as embodied herein and as modified in view of any variations that will be apparent to those skilled in the art.

BRIEF DESCRIPTION OF THE DRAWINGS

Embodiments of the invention are explained in greater detail by way of the drawings, where like reference numerals refer to the like features.

DETAILED DESCRIPTION OF THE INVENTION

The instant invention is directed to a pool or spa light having an at least one LED or plurality of LEDs or a plurality of LEDs in an array with at least a portion of the LED, LEDs, or LED array 20 in direct contact with or encapsulated in a lens body 10. The at least one LED or plurality of LEDs 20 is encapsulated in an optically clear lens body 10 allowing light to pass through the lens body 10, the lens body 10 being in direct contact with the water of the pool or spa. The at least one LED 20 can be coupled to a controller 80 and a power source (not shown).

Figure 1A:
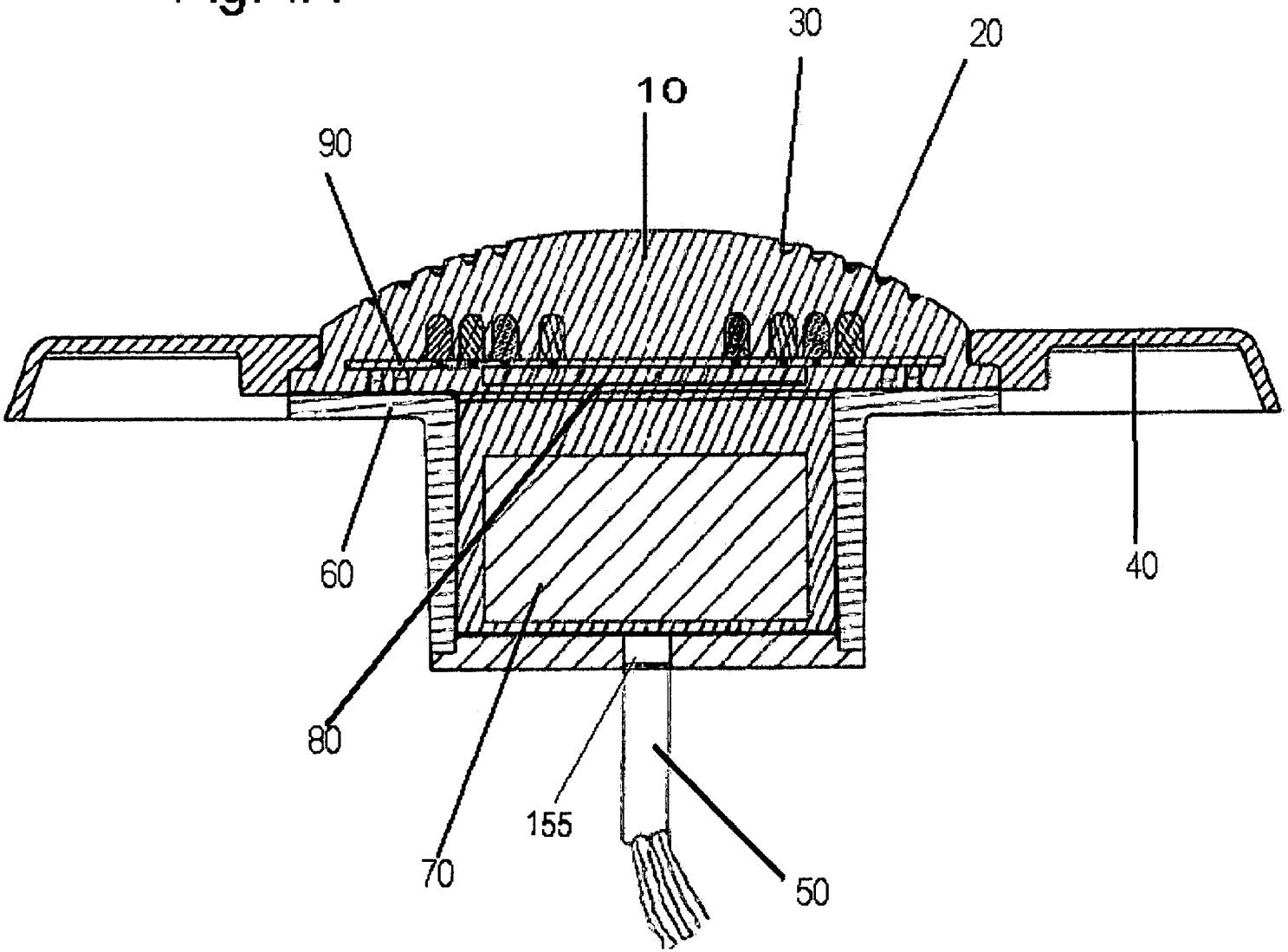
FIG. 1A illustrates a cross-sectional view of an exemplary embodiment of the instant invention.

FIG. 1A illustrates a cross-sectional view of an exemplary embodiment of the instant invention. In the embodiment, a lens body 10 is shown with an at least one LED, in this case an LED array 20. The pool or spa light is set in a cavity 60 typically within the body of water being illuminated. The lens body 10 can be molded into a variety of shapes and sizes depending on the application. Some of these shapes will diffuse the light and some will concentrate the light the shapes may also vary due to aesthetics. The LED array 20 is mounted on a printed circuit board 90. The at least one LED or the LED array 20 can comprise single color LED's, multiple color LED's, multiple LED's having different colors, multiple LED's having multiple colors, and any combination therein. For example, the exemplary embodiments can utilize an at least one tri-color LED or a single colored LED, depending on the application of water feature and desired light output. Multiple printed circuit boards may also be mounted as part of the LED array 20. These boards may have, for example, single LEDs, rows of LED's, LED's laid out in staggered or geometric shapes and arrays. The LED array 20 can be installed in any pattern depending on the shape and rating of the bulb and similar design constraints. The at least one LED, in this instance a plurality of single colored LEDs 20, are placed on a printed circuit board 90 which can have its own independent electronics on the board for controlling the at least one LED.

The LED array 20 and the printed circuit board 90 in the exemplary embodiment shown are encased in the lens body 10. The lens body 10 may comprise any suitable material. The suitable material would permit transmission of the light from the LED with a minimum of transmission loss. An optically clear epoxy resin is a non-limiting example of the type of material that may be utilized. Thus, by doing away with the need for a water tight compartment or gap or space between a lens and an at least one LED the complexity of the housing of the bulb is significantly reduced and the ability to cool the at least one LED significantly increased, thereby reducing the cost of manufacture of the device and improving the overall longevity.

In addition, the LED array 20, as it is encapsulated and in contact with the lens body 10, can be run at higher intensity as the water in the water feature acts as a very large heat sink. This direct contact of the lens body 10, and thereby the LEDs, with the water improves both intensity and luminosity and also allows for a wider variety of color changes not possible in previous lighting systems.

A power source (not shown) is coupled via a power source cord 150. The power source cord 150 can be hard wired to the lamp or coupled via a coupling 155. In the embodiment shown in FIG. 1, the power cord 150 is directly coupled to a transformer 70. Transformer 70 is, for example but is certainly not limited to, a toroid transformer for stepping down an AC input to a 12-Volt DC input for the light fixture. In further exemplary embodiments, a bridge rectifier circuit may be utilized in conjunction with the controller 80 and/or the transformer 70. A low voltage circuit, in all cases, will drive the at least one LED to help ensure safety. Using a low voltage in the circuit reduces the possibility of severe injury if the circuit should short through the water feature and the water channel.

Figure 4A:
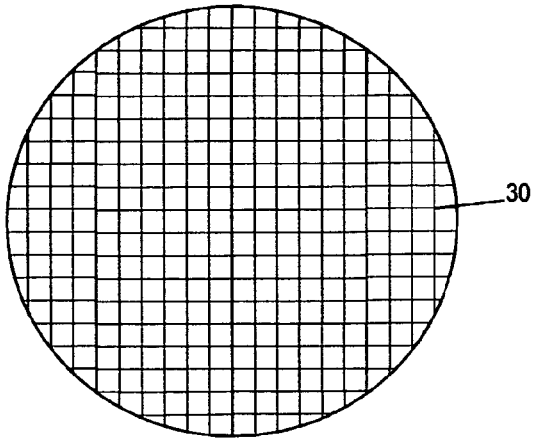
FIGS. 4A-4C show further exemplary embodiments with various diffuser patterns
Figure 4B:
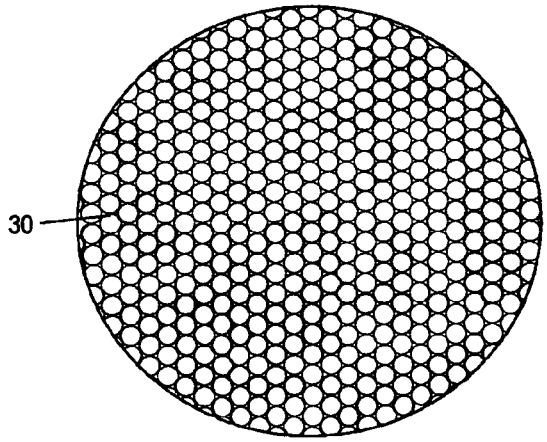

A controller 80 can also be provided. The controller 80 can be mounted inside the light or coupled to the printed circuit board 90 from an external control system or can be incorporated directly on the printed circuit board 90. In the embodiment shown in FIG. 1A, the LED array 20, the printed circuit board 90, and the controller 80 are placed encased in the lens body 10. The controller 80 can control any number of parameters. These can include, for example, but are not limited to color changes including color blending, bleeding, or other color pattern; luminosity patterns including flashing, fades and other changes in luminosity; and other changes in the states of the at least one LED. Additionally, this light fixture may also be controlled from an external controller. The external controller can be a standard wired controller or a wireless controller, as shown in the embodiments of FIGS. 4A and 4B respectively.

The light fixture in all the exemplary embodiments disclosed is designed so it can be operated in a wide voltage range. The typical application is in the form of a 120-volt light fixture that would be designed to include a plastic housing that attaches or otherwise couples to the printed circuit board 90 to include a 120-volt to 12-volt transformer, which could be encapsulated in the epoxy or similarly located outside the epoxy housing. The invention can also be designed so it can accommodate a bezel 40 to provide a finished look and to help fit into new pools and spas and to facilitate its introduction into the retrofit market.

Figure 1B:
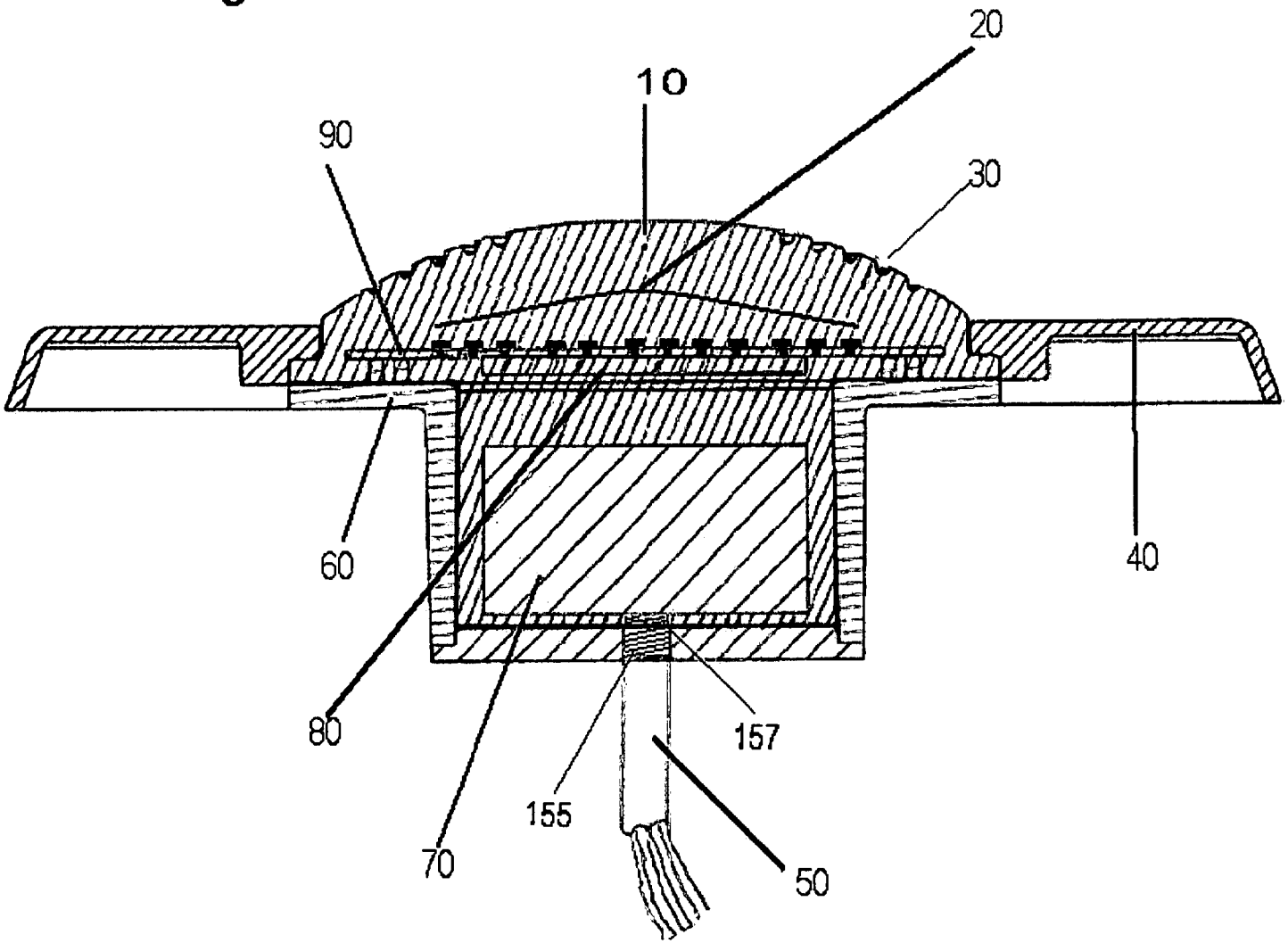
FIG. 1B illustrates a cross-sectional view of an exemplary embodiment of the instant invention with a screw type electrical connection.

FIG. 1B illustrates a cross-sectional view of an exemplary embodiment of the instant invention with a screw type electrical connection. The further embodiment of the instant invention provides for a single unitary lens body 10 containing all the diodes that will emit light 201. The exemplary embodiment shown omits the individual lenses and provides a series of light emitting diodes contained within an optically clear, highly heat transmissive material. This allows for maximum luminosity from the diodes. Moreover, as the lens body is in direct contact with both the diodes and the water and is heat transmissive, the diodes are efficiently cooled by active conduction of heat through the unitary, optically clear, highly heat transmissive material. Examples of suitable optically clear, highly heat transmissive/conductive materials include glass, quartz, optically clear epoxies, optically clear plastics with metallic conducting rods, composites, and other suitable materials. The embodiment of FIG. 1B is also a direct replacement for an incandescent screw in bulb. The incandescent bulb (not shown) is typically coupled to the power source via a screw-in coupling 155. The lens body 10 includes a threaded, screw in end portion 157 that mates with the coupling 155. This end portion 157 is coupled to transformer 70 and provides power to the bulb.

Figure 2A:
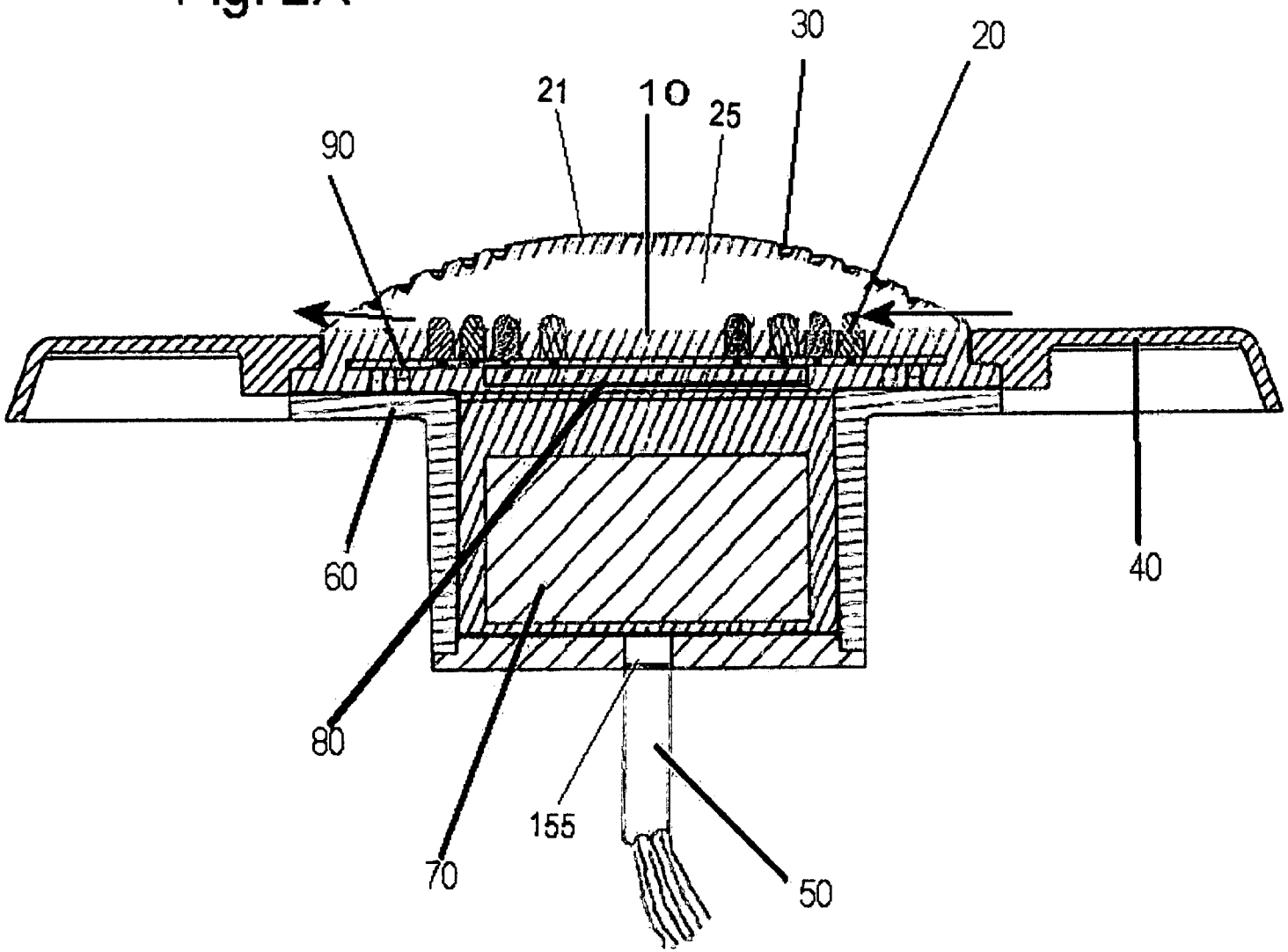
FIG. 2A shows another cross section view of an exemplary embodiment of the instant invention.
Figure 2B:
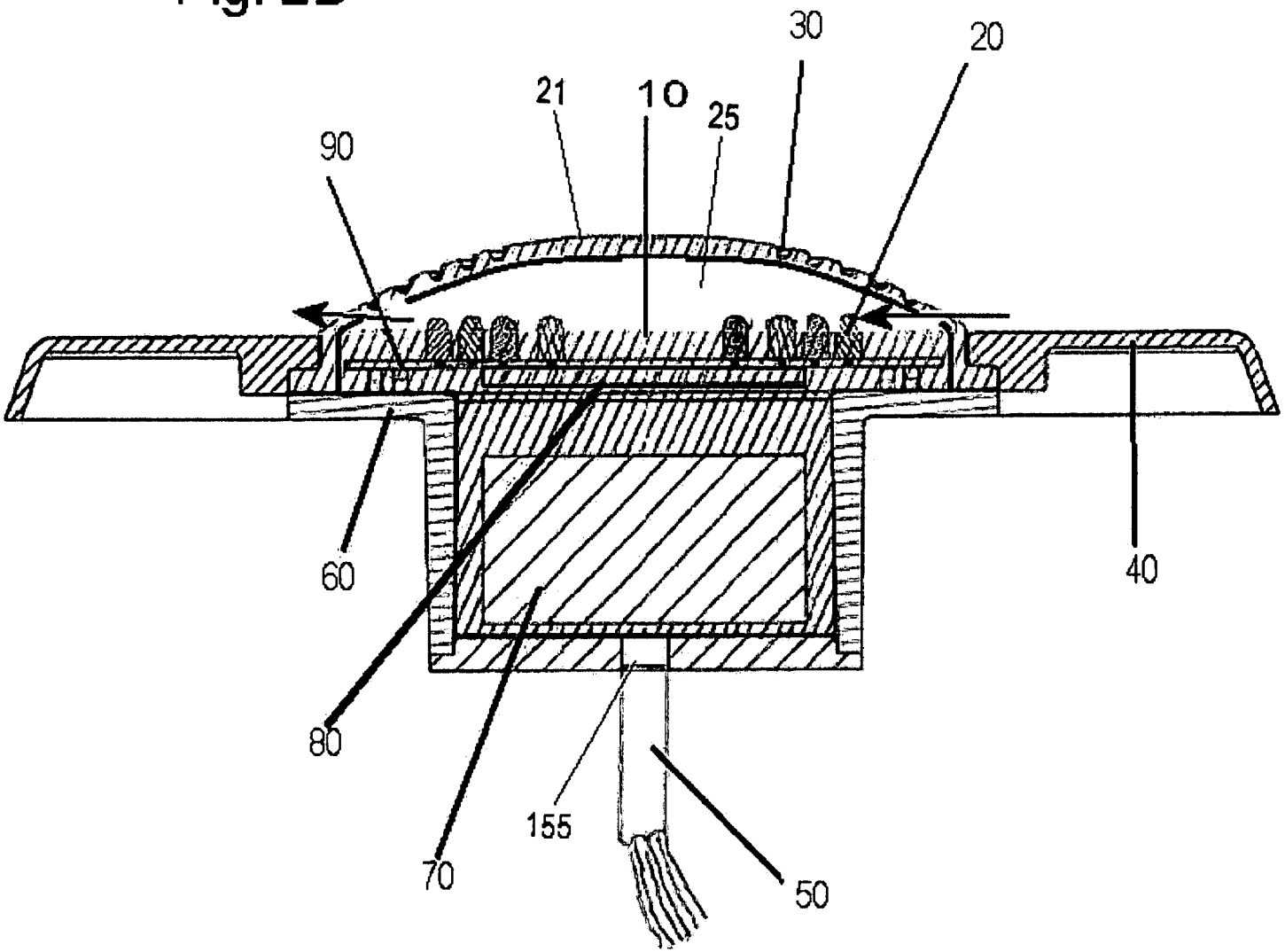
FIG. 2B shows a still further cross section view of an exemplary embodiment of the instant invention.

FIGS. 2A and 2B show a still further embodiment of the instant invention. In the embodiment shown, the embodiment includes a cooling cavity 25 with vents 22, 24 for inflow and outflow of water from the body of water being illuminated. A covering or protective lens 21 is provided. The covering or protective lens 21 can be attached to the lens body 10 to make a unitary light fixture or can be a separate component, as shown in FIGS. 2A and 2B respectively. Water flows into the cavity through an inlet vent 22, as depicted by the arrows. The water within the cavity 25 is heated by the output of the LED array and the heated water rises and escapes through the outflow vent 24, essentially creating a convective cell or current within the cavity 25. The at least one LED, again here an LED array 21, is embedded in a potting compound, such as optically clear epoxy or a heat transmissive optically clear material.

Similar to previous exemplary embodiments, the exemplary embodiments of FIGS. 2A and 2B may have a circuit board 80, lens body 10, transformer 70, power source cord 150 and similar additional components as described herein. These components may have similar capabilities, locations, proximities, and capabilities as those previously described or may be adjusted to fit within the design considerations of the instant exemplary embodiments. Additionally, the controller 70 may be provided in the onboard configuration, as shown, or externally or in any manner appropriate to provide control of the light fixture. Further exemplary embodiments may utilize the controller configurations shown in FIGS. 4A and 4B described herein or other configurations.

The result or the exemplary embodiments is a spa or pool light that is actively cooled allowing for the light emitting diodes to be operated at greater intensity and, therefore, luminosity from the LED array 20 while maintaining the integrity of the unit and allowing for focusing through the lens body 10 and the covering lens 20. As seen in FIG. 1B, further modifications to this embodiment would permit for a removable lens that separates from the body containing the LED array. This lens could be held in place by the bezel 40 and replaced to provide a variety of lighting colors and effects as desired.

Figure 3A:
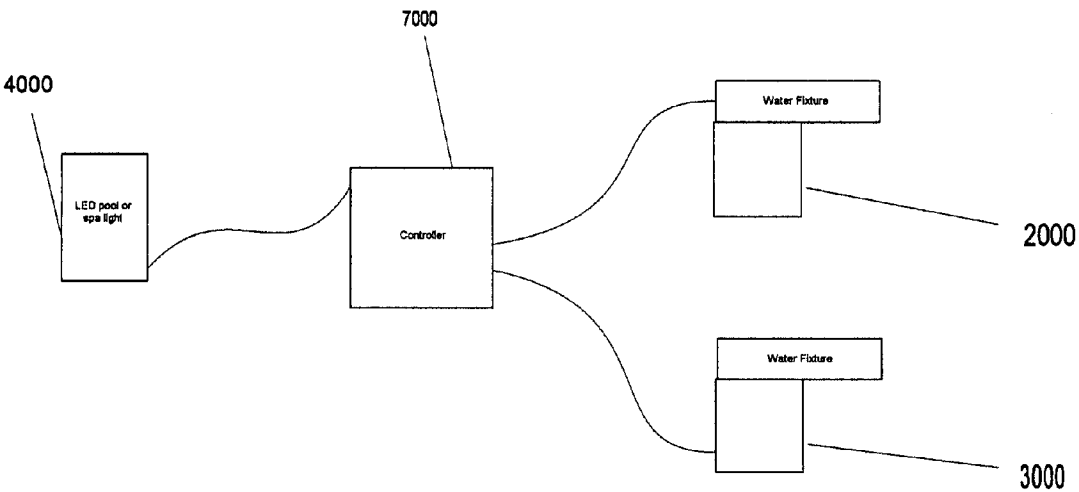
FIGS. 3A and 3B shows exemplary embodiments of a master controller setup utilizing the instant invention.
Figure 3B:
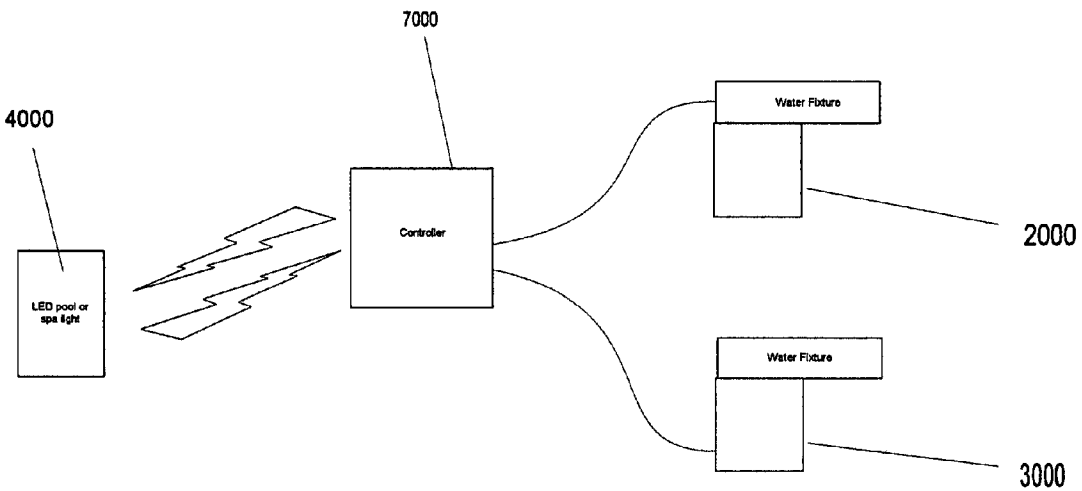

FIGS. 3A and 3B show the instant invention with an external controller. In the exemplary embodiments shown in FIG. 3A, the at least one LED 20 is a light fixture represented as one of an at least one water features 2000, 3000, 4000, that can be controlled from master control 7000 which is independent of any one of the particular water features. The master controller 7000 can be placed away from the individual water features 2000,3000,4000 and will control the water feature lighting from the location it is placed. This can be done by normal wired connection or wirelessly as shown in FIG. 3B.

Figure 4C:
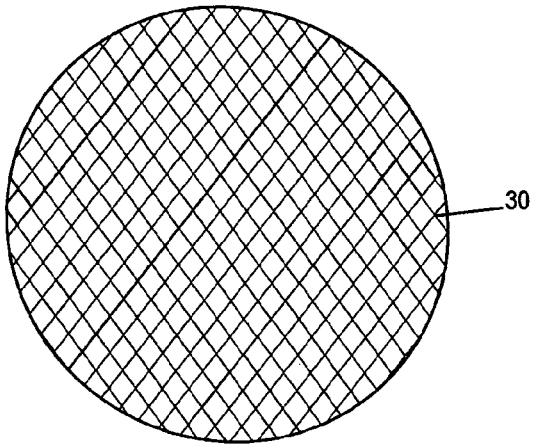

FIGS. 4A to 4C show front views of various embodiments of the instant invention. The optically transparent epoxy of the lens body 10 can be molded into a variety of shapes and sizes depending on the application. Some of these shapes will diffuse the light and some will concentrate the light the shapes may also vary due to aesthetics. Taking advantage of the long life (100,000 hours) and low power of the LED array 20, each of the embodiments shown in FIGS. 4A to 4C show different lens diffusion patterns 30. In the exemplary embodiment of FIG. 1, the lens body 10 is provided with a diffuser pattern 30 that is a plurality of raised concentric ridges or circles. This pattern may also comprise, for example, but is not limited to a grid of circles as shown in FIG. 4B, a grid of squares as shown in FIG. 4A, and a grid of diamonds as shown in FIG. 4C or similar light diffusing patterns depending on the desired direction of the lighting and diffusing. The various shapes for diffusion patterns are typically oriented, but not limited to, rows of grooves with rows at approximately 90 degrees from a direction of the opposite side grooves. These grooves are typically V-shaped grooves and can be detents in or project from the lens body 10. In addition, the lens body 10 and the diffuser pattern 30 can be coated in a hardened protective outer layer 35, this may be for example, but is not limited to, a quartz coating. This hardened protective outer layer 35 can be provided to help protect against scratches and improve diffusion.

Figure 5:
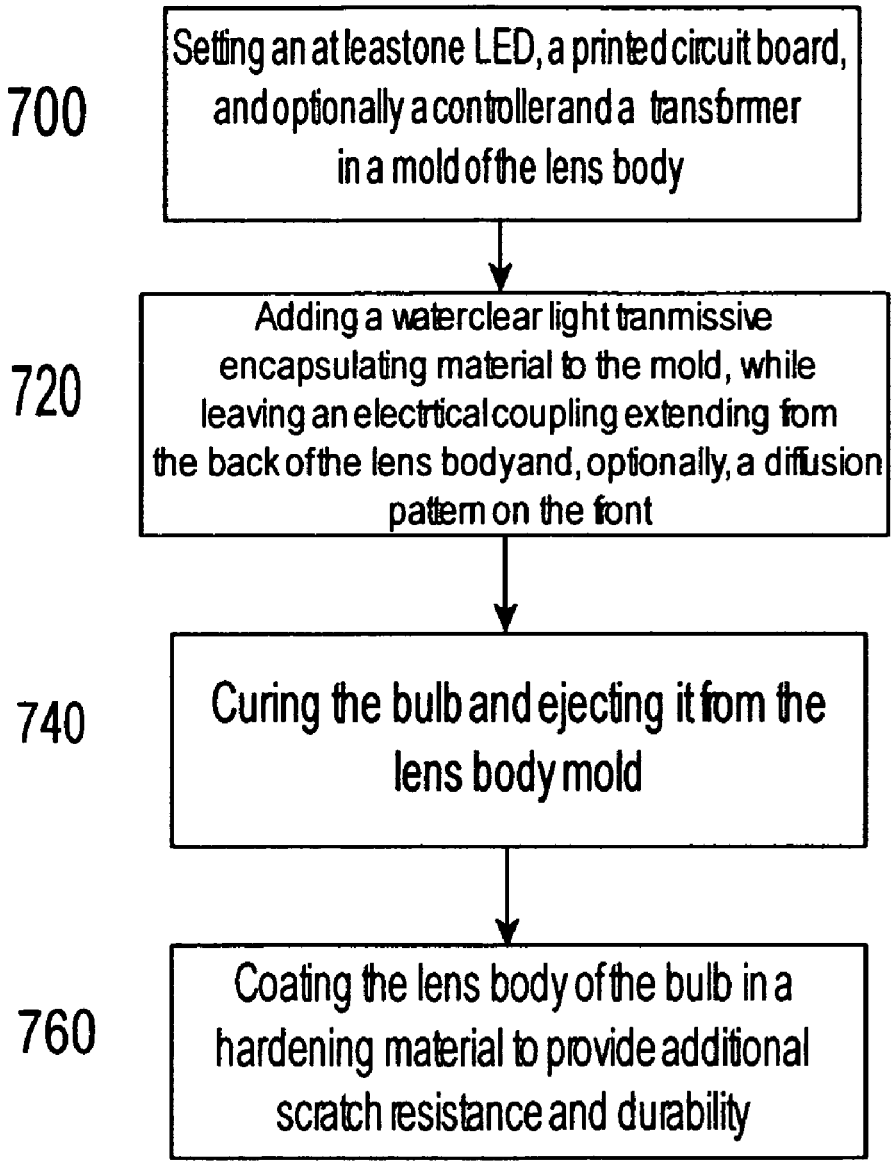
FIG. 5 shows a flow chart of an exemplary method of manufacture of the instant invention.

FIG. 5 shows a flow chart for the method of making the instant invention. The LED array 20, the printed circuit board 90, and the controller 80 are placed in a mold in step 700. Once properly set in the mold, a suitable lens body 10 material is added in step 720. A non-limiting example of a suitable material is a water clear optically clear epoxy resin. The epoxy resin can comprise, for example, the same chemical base as an LED lens or any similarly optically clear, transmissive material. The material is poured into the mold and encapsulates all electronic components. Only the power cord 150 and/or the electrical couplings 155 provided in the back of the poured lens body 10 extend from the lens body 10.

The mold into which the epoxy is poured has an LED diffuser form on the front of it that provides a diffuser pattern in the epoxy body. The diffuser pattern 30 may comprise, for example, but is not limited to a series of concentric circular patterns, a grid of circles, a grid of squares, a grid of rectangles, and a grid of diamonds or similar light diffusing patterns depending on the desired direction of the lighting and diffusing when the lens body is cured in step 740. Similar steps are utilized to provide for the embodiments of FIGS. 2A and 2B, providing that the mold used in step 700 provides for the water cavity 25. In an optional step 760, the lens body and the encapsulated at least one LED may be further coated in a hardened protective outer coating. This coating may be any suitable coating, for example, but not limited to, a quartz coating.

After the lens body hardens in step 740 or after application of the hardening material in step 760, it is removed from the mold and a water tight, sealed LED light fixture or bulb is formed. The lens body acts to encapsulates all the electronic components and seal them from contact with the water and safely prevent any electrical shock to swimmers. The lens body also acts as a formed lens because it is water clear and lets the light pass through. In the embodiments of FIGS. 2A and 2B the formed lens body allows for the lenses of the LEDs to contact the water directly. The front of the lens body may have the defusing pattern to defuse the light emitted from the LEDS and helps with the color blending of the light as desired.

The embodiments and examples discussed herein are non-limiting examples. The invention is described in detail with respect to preferred embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. A light emitting diode pool or spa lamp bulb, comprising:

an at least one light emitting diode;

an at least one unitary, parabolic lens body that is optically clear with the at least one light emitting diode embedded in the at least one unitary, parabolic lens body, the lens body being in direct contact with the pool or spa; and an at least one controller coupled to a printed circuit board, the printed circuit board coupled to and mounting the at least one light emitting diode.

2. The light emitting diode pool or spa lamp bulb of claim 1, wherein the printed circuit board mounts the at least one controller.

3. The light emitting diode pool or spa lamp bulb of claim 2, wherein the printed circuit board and the controller are embedded in the at least one unitary, parabolic lens body.

4. The light emitting diode pool or spa lamp bulb of claim of claim 1, wherein the controller is located outside the bulb.

5. The light emitting diode pool or spa lamp bulb of claim 4, wherein the controller is a wireless controller system having a wireless controller coupled wirelessly to a user input.

6. The light emitting diode pool or spa lamp bulb of claim 3, wherein a power source is coupled to the printed circuit board through a coupling.

7. The light emitting diode pool or spa lamp bulb of claim 6, wherein the coupling is a screw in coupling.

8. The light emitting diode pool or spa lamp bulb of claim 6, wherein the coupling is a pin and plug coupling.

9. The light emitting diode pool or spa lamp bulb of claim 6, further comprising a transformer coupling the power source and the printed circuit board.

10. The light emitting diode pool or spa lamp bulb of claim 6, further comprising a rectifier circuit coupling the power source to the printed circuit board.

11. The light emitting diode pool or spa lamp bulb of claim 1, wherein the at least one light emitting diode is an array of light emitting diodes.

12. The light emitting diode pool or spa lamp bulb of claim 11, wherein the array of light emitting diode is an array of multi colored light emitting diodes.

13. The light emitting diode pool or spa lamp bulb of claim 1, further comprising a receiving cavity and a bezel, the bezel fitting around the light emitting diode bulb and retaining the bulb in the receiving cavity.

14. The light emitting diode pool or spa lamp bulb of claim 3, wherein the at least one unitary, parabolic lens body further comprises a diffusing pattern on a surface of the at least one unitary, parabolic lens body in contact with the pool or spa.

15. The light emitting diode pool or spa lamp bulb of claim 14, wherein the diffusing pattern is comprised of a plurality of indents or projections in at least one of a series of concentric rings, a grid of squares, a grid of rectangles, a grid of small circles, and a grid of diamonds.

16. The light emitting diode pool or spa lamp bulb of claim 12, wherein the controller includes a rectifier circuit for converting a 12 volt-ac source applied to the light emitting diode lamp bulb through electrical connections in a screw-type base to a 12 volt-dc circuit for supplying electrical power to an array comprised of the plurality of different colored light emitting diode bulbs.

17. A pool or spa light, the light being recessed in an alcove in the wall or floor of the pool or spa, the light comprising:

a plurality of light emitting diodes;

a printed circuit board having the plurality of light emitting diodes planted thereon;

an at least one unitary lens body, the lens body comprised of an optically transmissive material that encapsulates the plurality of light emitting diodes and the printed circuit board; and an electrical coupling that couples the multiple light emitting diodes to a power source, wherein the printed circuit board and plurality of light emitting diodes are encapsulated in the lens body and oriented to face into the pool or spa such that no gap or air space is provided and when the lens body is submerged in the pool or spa the multiple light emitting diodes are in direct contact with the lens body which is directly cooled by the pool or spa.

18. The pool or spa light of claim 17, further comprising an at least one controller controlling the plurality of light emitting diodes.

19. The pool or spa light of claim 17, wherein the printed circuit board mounts the at least one controller thereon.

20. The pool or spa light of claim 19, wherein the controller is embedded in the lens body.

21. The pool or spa light of claim 18, wherein the controller is located outside the bulb.

22. The pool or spa light of claim 21, wherein the controller is a wireless controller system having a wireless controller coupled wirelessly to a user input.

23. The pool or spa light of claim 17, wherein the electrical coupling is a screw in coupling.

24. The pool or spa light of claim 17, wherein the coupling is a pin and plug coupling.

25. The pool or spa light of claim 17, further comprising a transformer coupling the power source and the light emitting diodes.

26. The pool or spa light of claim 17, further comprising a rectifier circuit coupling the power source to the printed circuit board.

27. The pool or spa light of claim 17, wherein the plurality of light emitting diode is a plurality of multi colored light emitting diodes.

28. The pool or spa light of claim 17, further comprising a bezel, the bezel fitting around the light emitting diode bulb and retaining the bulb in the receiving alcove.

29. The pool or spa light of claim 17, wherein the lens body further comprises a diffusing pattern on a surface in contact with the pool or spa.

30. The pool or spa light of claim 29, wherein the diffusing pattern is comprised of a plurality of indents or projections in at least one of a series of concentric rings, a grid of squares, a grid of rectangles, a grid of small circles, and a grid of diamonds.

31. The pool or spa light of claim 27, further comprising a controller that includes a rectifier circuit for converting a 12 volt-ac source applied to the plurality of light emitting diodes through electrical connections in a screw-type base to a 12 volt-dc circuit for supplying electrical power to the plurality of multi-colored light emitting diodes.

32. A method of manufacturing a unitary, parabolic light emitting diode spa or pool bulb, comprising the method steps of:

setting a plurality of light emitting diodes on a printed circuit board in a in a unitary light emitting diode spa or pool bulb lens body parabolic mold;

adding water clear encapsulating material to the lens body mold to encapsulate all electrical components with an electrical coupling at the back of the light emitting diode spa or pool bulb mold; and ejecting the completed unitary, parabolic light emitting diode spa or pool bulb.

33. The method of manufacturing of claim 32, further comprising the method step of applying a diffuser pattern in the bulb.

34. The method of manufacturing of claim 32, the method step of setting further comprises setting a printed circuit board with a controller and a transformer, the transformer being coupled to the printed circuit board and having an electrical coupling, wherein in the encapsulating step the electrical coupling from the transformer extends out from the encapsulation.

35. The method of manufacturing of claim 32, further comprising the method step of applying a hardened surface coating to the light emitting diode bulb.

36. The method of manufacturing of claim 35, wherein the method step of applying a hardened surface coating further comprises applying a coating of quartz to the light emitting diode bulb.

37. The bulb of claim 1, further comprising a hardened layer applied over the lens body.

38. The bulb of claim 37, wherein the hardened layer is a layer of quartz applied over the lens body.

39. The bulb of claim 17, further comprising a hardened layer applied over the lens body.

40. The bulb of claim 39, wherein the hardened layer is a layer of quartz applied over the lens body.

41. A pool or spa light mounted within a pool or spa comprising:

an at least one lens body;

at least one light emitting diode embedded and extending at least partially from the at least one lens body;

a mounting cavity within the pool or spa having the lens body mounted therein;

an at least one covering lens mounted in front of the at least one lens body to form a water filled cavity, the at least one covering lens having an at least one water inlet and an at least one water outlet, wherein water is induced into and out of the cavity by a convective current generated from the cooling of heat generated by the at least one light emitting diode.

42. The pool or spa light of claim 41, wherein the at least one light emitting diode is a plurality of light emitting diodes.

43. The pool or spa light of claim 42, wherein the plurality of light emitting diodes is of multiple colors.

44. The pool or spa light of claim 41, further comprising a controller is provided to control the color of the plurality of light emitting diodes.

45. The pool or spa light of claim 44, further comprising at least one of a transformer, a power source cord, an electrical coupling, an at least one printed circuit board, and a bezel.

46. The pool or spa light of claim 45, wherein at least one of the controller, the transformer, and the at least one printed circuit board is embedded in the at least one lens body.

47. The pool or spa light of claim 41, wherein the at least one lens body is a single lens body.

48. The pool or spa light of claim 47, wherein the single lens body is composed of a thermally conductive, optically clear material.

49. The pool or spa light of claim 41, further comprising a protective coating covering the at least one lens body and the at least one light emitting diode.

50. The pool or spa light of claim 41, wherein the at least one covering lens is formed as a part of the at least one lens body.

51. The pool or spa light of claim 41, wherein the at least one covering lens is separate from the at least one lens body.

* * * * *